US007744138B2

(12) United States Patent
St. Germain

(10) Patent No.: US 7,744,138 B2
(45) Date of Patent: Jun. 29, 2010

(54) EDGE PROTECTOR FOR USE WITH A SLING

(75) Inventor: Dennis St. Germain, Chadds Ford, PA (US)

(73) Assignee: Slingmax, Inc., Aston, PA (US)

( * ) Notice: Subject to any disclaimer, the term of this patent is extended or adjusted under 35 U.S.C. 154(b) by 0 days.

(21) Appl. No.: 11/648,417

(22) Filed: Dec. 29, 2006

(65) Prior Publication Data

US 2008/0157549 A1 Jul. 3, 2008

(51) Int. Cl.
*B66C 1/12* (2006.01)

(52) U.S. Cl. ..... 294/74

(58) Field of Classification Search ..... 294/74; 410/99; 206/453, 486
See application file for complete search history.

(56) References Cited

U.S. PATENT DOCUMENTS 4,039,217 A 8/1977 Bryant
4,039,218 A 8/1977 Bryant
4,441,748 A 4/1984 St. Germain
4,877,673 A * 10/1989 Eckel et al. ..... 206/453
4,938,357 A * 7/1990 Schmidt ..... 206/453
5,385,236 A * 1/1995 Cowan et al. ..... 206/453
5,584,623 A * 12/1996 Nadherny ..... 410/99
5,848,865 A * 12/1998 Beals ..... 410/99
5,943,963 A * 8/1999 Beals ..... 410/99
6,470,637 B2 10/2002 Gratz
6,848,203 B2 2/2005 Hohmann et al.
7,311,483 B1 * 12/2007 Nudo ..... 410/99

FOREIGN PATENT DOCUMENTS

DE 4018584 A1 12/1991
SU 1217769 A1 9/1984

* cited by examiner

*Primary Examiner*—Paul T Chin
(74) *Attorney, Agent, or Firm*—Stradley Ronon Stevens & Young, LLP

(57) ABSTRACT

An edge protector, including a flexible body portion, spacers, and mating straps, that protects slings from both abrasion damage and cutting damage caused by a heavy object being lifted.

19 Claims, 4 Drawing Sheets

EDGE PROTECTOR FOR USE WITH A SLING

FIELD OF THE INVENTION

This invention relates to protectors and, in particular, an edge protector for use with industrial slings designed to lift heavy loads.

BACKGROUND OF THE INVENTION

Industrial slings are designed to lift, transport and move extremely heavy loads. Thirty years ago, the vast majority of industrial slings were made of metal (either chains or wire rope). More recently, non-metal or synthetic slings have gained popularity and are replacing metal slings in many circumstances.

Synthetic slings are usually comprised of a lifting core made of twisted strands of synthetic fiber and an outer cover that protects the core. The outer cover plays an important role in synthetic slings. The cover is designed to move with respect to the inner core in order to reduce the likelihood of wear points. Also, the outer cover provides a means for protecting the inner core from the elements (e.g., heat, cold, chemicals, etc.). Therefore, once the cover is damaged the probability that the load-bearing inner core will be exposed and damaged increases dramatically.

When a metal sling was used to lift an abrasive load/object (e.g., one made of concrete) or any object having a sharp edge, there was little concern that the metal sling would be damaged. However, with the advent of synthetic slings, the damage that may be done to the outer cover by an abrasive or sharp object is of particular concern. The size and/or shape of the load/object may require that the sling be placed next to an abrasive surface or, more commonly, against an edge (e.g., an elongated stretch where two pieces of metal are joined to form a 90° angle) of the load to be lifted. The tremendous force applied to the sling at the point of contact with the load being lifted may damage the sling.

Some large objects that have particularly sharp edges or which are particularly unwieldy undergo the additional manufacturing step of attaching ring bolts, eye bolts or lifting loops in order to accommodate the slings needed to move the objects. If the object being lifted is made of metal, the eye bolts are attached by welding ring-shaped pieces to the object. For example, large pipe sections, cargo ship sections, structural steel for a sky scraper or bridge section may be manufactured with multiple eye bolts.

It should be noted that the eye bolts cannot be placed just anywhere on the object to be lifted. The eye bolts must be placed at points accessible by the slings, so that during a lift the load is stable. In addition, the load must be properly oriented once it is lifted or moved into position. Specifically, the eye bolts must take into consideration the center-of-gravity of the object so that the object does not drop into an odd position or begin to spin uncontrollably as it is being lifted.

Once the object is moved to its final destination and placed in its permanent position, the eye bolts may be removed from the object by cutting, burning or unwelding. Clearly, the extra steps of calculating the object's center-of-gravity, attaching the plurality of eye bolts in an appropriate location and then removing the eye bolts after the object has reached its final destination increases the time and cost of a lifting operation. Moreover, if the load is not made of iron it is much more difficult to attach eye bolts.

For shipping purposes, it is known to manufacture protectors by forming angular pieces of cardboard to abut against various goods/objects. Also, foam inserts that are custom designed to fit against the edge of a particular object serve a similar purpose. The protectors are designed to absorb some of the force to which the object will be exposed during normal shipping and handling. For example, televisions, filing cabinets, furniture, computers, washers, refrigerators and similar appliances are shipped inside cardboard boxes, with protectors placed along several edges, thereby providing a measure of protection. These types of protectors are designed to protect the object during shipping and handling. As long as the goods are protected, the destruction of the cardboard boxes and the foam protectors are irrelevant since they are disposed of once the goods are unpacked.

U.S. Pat. No. 6,470,637 to Jeffrey Gratz discloses a corner protector made of molded pulp that protects goods/objects such as windows during shipments. The corner protector disclosed in U.S. Pat. No. 6,470,637 is inexpensive to manufacture. Since it is disposed of once the window reaches its destination and is unpacked, the corner protector disclosed in U.S. Pat. No. 6,470,637 is designed to be biodegradable.

The aforementioned cardboard and foam protectors are specifically designed and shaped to protect the contents (i.e., the object being shipped or moved). They are not designed to protect the means used to lift the object (e.g., a sling, rope, fork-lift, overhead crane, etc.). Furthermore, the cardboard and foam protectors would provide negligible protection when used under the conditions in which industrial slings are used. Accordingly, there is a need in the industry to develop an apparatus that could be quickly and safely (and preferably releasably) secured to an industrial sling, lifting or towing chains, wire rope, etc. that would protect the sling, towing chain, wire rope, etc. from abrasive or sharp edges at the points where the sling contacts its load.

SUMMARY OF THE INVENTION

The present invention is a reversible edge protector designed for use with industrial slings. Industrial slings are designed to lift heavy and usually bulky loads. Such heavy loads may not be intended to be lifted or moved very often and, many times, are unique (e.g., a section of a bridge); therefore, there is usually little consideration given to the rigging needed to ship and place the load into its final position.

Industrial slings used to lift heavy loads must come in contact with the load at one or more places. Further, depending on the shape and center-of-gravity of the load, the sling must be positioned at specific points. It is not uncommon for the load to have sharp corners or other features that may damage the cover of the sling. Even relatively simple-shaped loads (e.g., container boxes having a box shape), have edges that can damage a sling. Accordingly, there may be little choice other than to have the sling abut the load at a place that will cause damage to the sling (or cause damage to the load) during lifting or moving.

The present invention is designed to protect slings (in particular, synthetic slings) from the relatively sharp corners and edges of the objects to be lifted. In a preferred embodiment, the edge protector utilizes a pair of attachment straps having hook and loop strips (i.e., Velcro® fasteners) for easy application on and removal from a sling.

It should be noted that both metal and non-metal slings can be damaged by the load. In addition, the force on the sling applied by the load is equal to the force on the load applied by the sling. Therefore, there is a significant chance that the load will be damaged by the sling during the lift.

BRIEF DESCRIPTION OF THE DRAWINGS

The accompanying drawings, which are incorporated in and form a part of the specification, illustrate the embodiments of the present invention and, together with the following description, serve to explain the principles of the invention. For the purpose of illustrating the invention, embodiments are shown in the drawings which are presently preferred, it being understood, however, that the invention is not limited to the specific instrumentality or the precise arrangement of elements or process steps disclosed.

In the drawings.

DETAILED DESCRIPTION OF THE PREFERRED EMBODIMENT

In describing a preferred embodiment of the invention, specific terminology will be selected for the sake of clarity. However, the invention is not intended to be limited to the specific terms so selected, and it is to be understood that each specific term includes all technical equivalents that operate in a similar manner to accomplish a similar purpose.

Preferred embodiments of the present invention will now be described in detail with reference to the accompanying drawings in which an edge protector in accordance with the present invention is generally referred to as referenced numeral 10.

In this disclosure, an edge is defined as the elongated seam or corner formed when at least two sides of an object meet. The most familiar type of edge is the 90° angle formed by two sides of a rectangularly-shaped object. However, an edge can be formed by joining two sides at virtually any angle. In fact, if an angle formed from two sides of an object is less than a right angle, the edge tends to be sharper. The present invention may be used to protect a sling from any sharp edge or surface on the load to be lifted.

The number of edge protectors used will depend on the shape of the load to be lifted and the number of slings used to lift the load. It is desirable to use an edge protector 10 in every location where the sling will come in contact with an edge/corner of the load.

Figure 1:
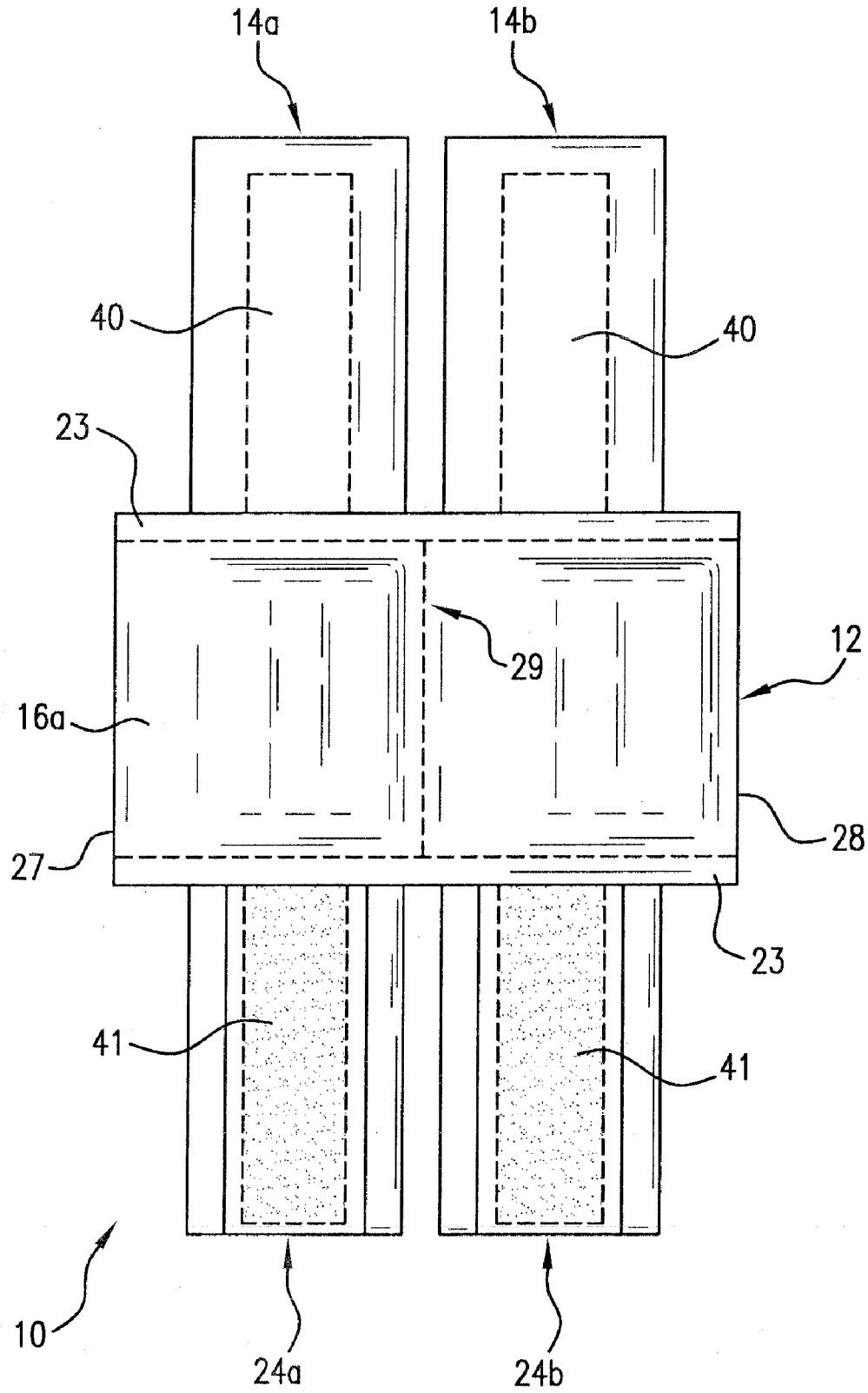
FIG. 1 is a plan view of an edge protector in accordance with the present invention.

Referring now to FIG. 1, the edge protector 10, shown in a top plain view, includes a body portion 12 and securing means 14*a*, 14*b*, 24*a*, and 24*b*. The body portion 12 is generally a rectangularly-shaped pocket preferably made of nylon material. The pocket of the body portion 12 may be formed from one elongated piece 16 of fabric twice as long as the desired length of the body section. The elongated piece 16 is then folded in half and the remaining three edges stitched together. One side of the elongated piece 16 may be left temporarily open to allow the insertion of spacers 18. Stitching 23 is shown along the longitudinal edges of the body section 12.

Figure 2:
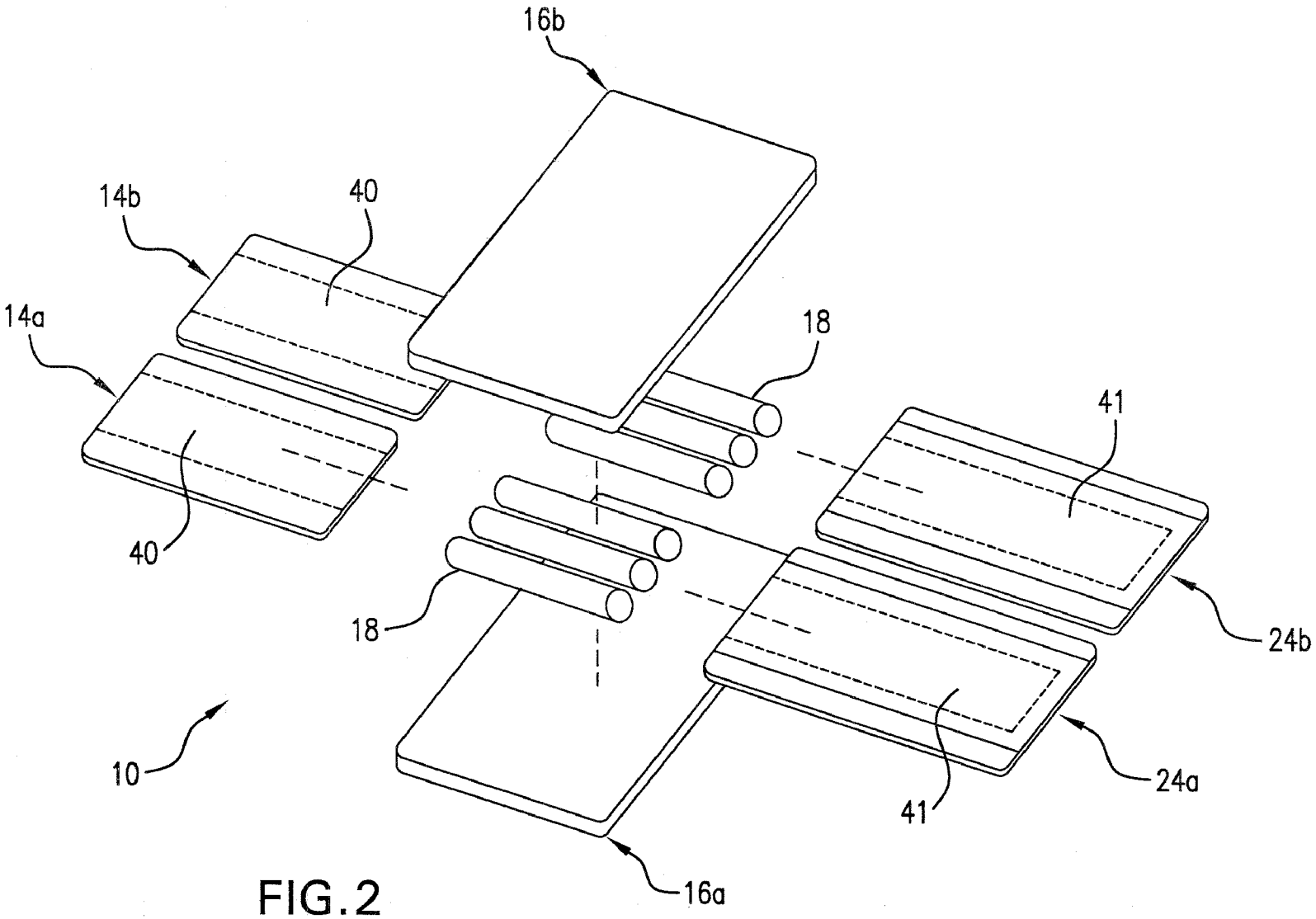
FIG. 2 is an exploded view of the edge protector illustrated in FIG. 1 showing the formation of the pocket of the body portion by two rectangularly-shaped pieces of material.

In an alternative embodiment illustrated in FIG. 2, the pocket of the body portion 12 may be made from two rectangularly-shaped pieces of fabric. A first rectangularly-shaped piece 16*a* is placed over a second rectangularly-shaped piece 16*b*. The pieces 16*a* and 16*b* of fabric are stitched together on their four sides to form a pocket between piece 16*a* and piece 16*b*. The pocket of body portion 12 may be left empty, or filled with foam or other cushioning material; however, in a preferred embodiment, as illustrated in FIG. 2, one or more spacers 18 may be inserted in the pocket.

Referring again to FIGS. 1 and 2, a securing means is used to attach the edge protector 10 to the sling 55. The securing means includes first 14*a* and 14*b*, and second 24*a* and 24*b* mating straps that are stitched along the longitudinal edges of the body section 12. Velcro® fasteners are attached to the respective straps. First mating straps 14*a* and 14*b* include hook-type fasteners 40 on their respective inner surfaces while second mating straps 24*a* and 24*b* have loop-type fasteners 41 on their respective outer surfaces. By wrapping straps 24*a*, 24*b* first around a sling (so that the loop-type fasteners face away from the sling), the edge protector can be releasably secured to the sling when the straps 14*a* and 14*b* are wrapped around the sling and the hook fasteners 40 line up and engage the loop-type fasteners 41 of straps 24*a* and 24*b*.

It is important to note that the edge protector 10 is reversible. That is straps 14*a* and 14*b* may be wrapped first around the sling 55 so that the hook fasteners 40 face away from the sling, then straps 24*a* and 24*b* may be wrapped around the sling allowing the loop-type fasteners 41 to link up and engage the hook-type fasteners. This feature will extend the operational life of the edge protector.

The length of the body portion 12 will generally depend on the shape/design of the load to be lifted. The width of the body portion 12 will generally depend on the width of the sling 55 used to lift the load. In a preferred embodiment, a nine-inch length for body portion 12 protects most loads. Also, the width of body portion 12 is preferably about two inches wider than the sling.

Figure 3:
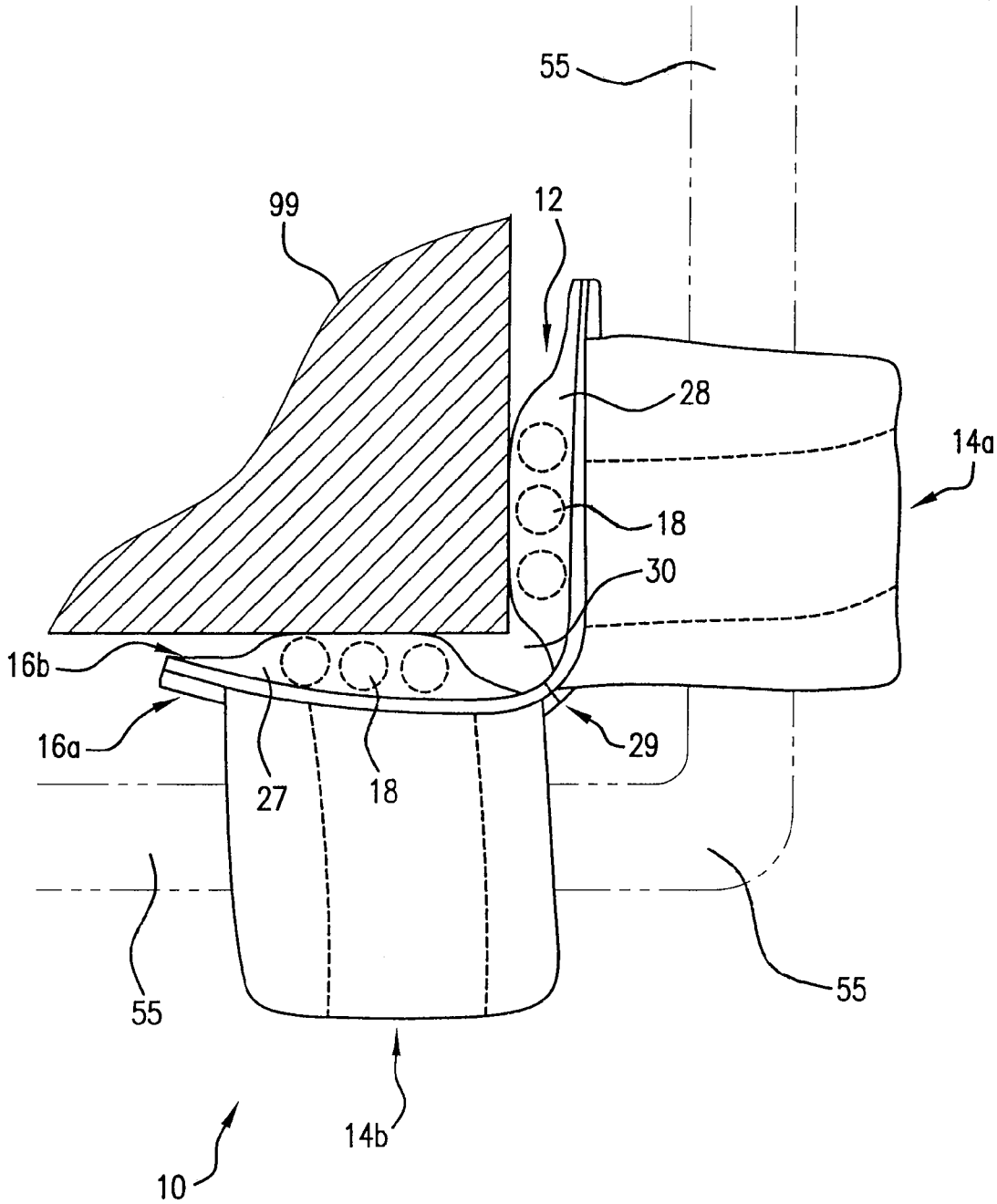
FIG. 3 is a side cutaway view of the edge protector illustrated in FIG. 1 showing the formation of a tunnel when the edge protector is abutted against a corner of a load.

The spacers 18 may be of any of a number of geometric shapes; however, they must be thick enough to prevent the corner of the load 99 from engaging the sling 55 as illustrated in FIG. 3. In a preferred embodiment, the spacers 18 are cylindrically-shaped as shown in FIG. 2.

It has been found that six cylindrically-shaped spacers 18, each having a diameter of ¾ inch, and a length slightly less than the width of the body section 12, are the preferred dimensions. However, the shape and weight of the load will determine the physical dimensions of the cylindrically-shaped spacers 18. The cylindrically-shaped spacers 18 may be made of any material that will not readily compress under the force needed to lift the load; some common materials include steel, aluminum and, most commonly, nylon.

Figure 4:
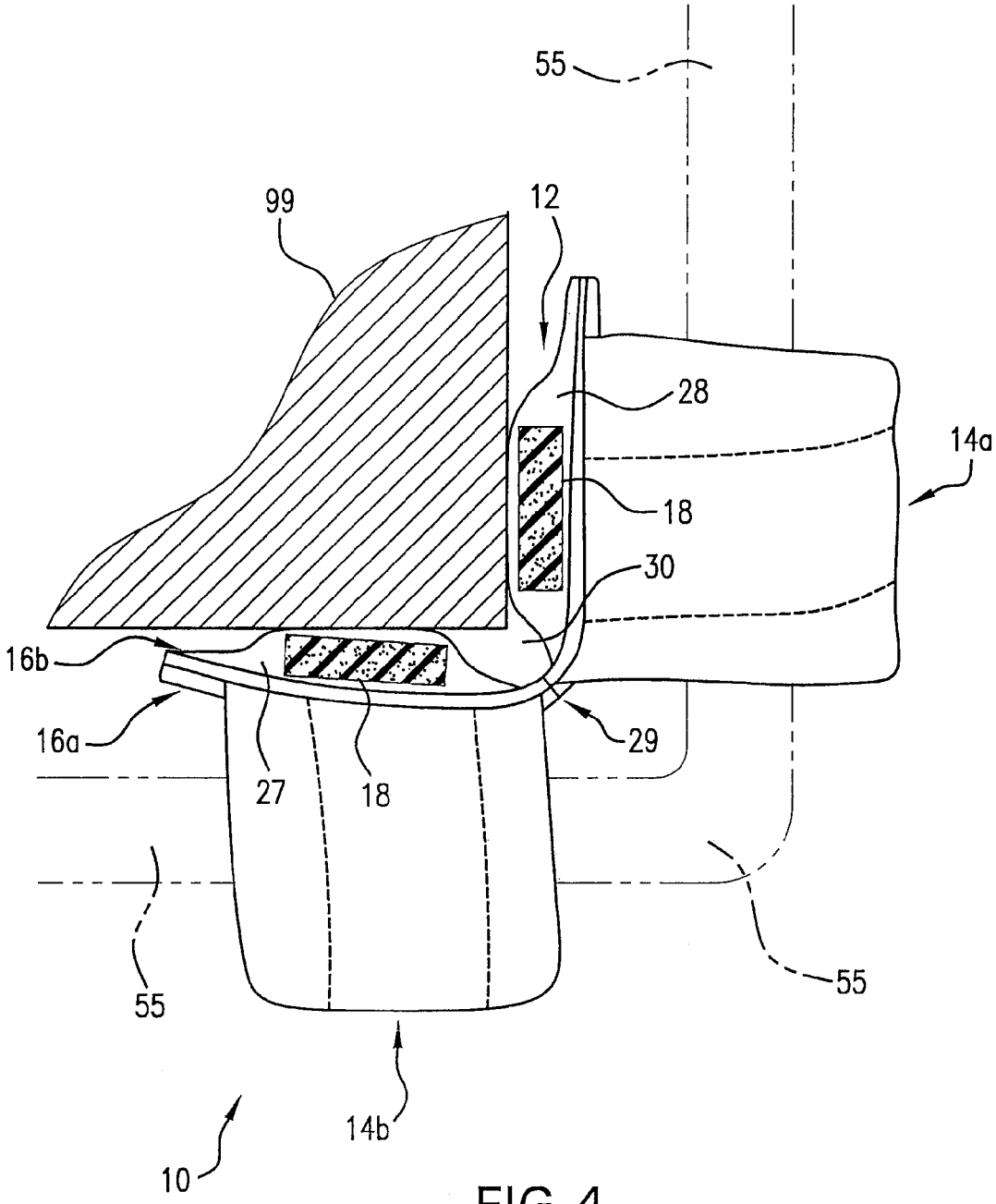
FIG. 4 illustrates an alternative embodiment of the edge protector shown in FIG. 3 where the cylindrically-shaped spacers have been replaced by a cushioning or foam material.

In an alternative embodiment, the spacers 18 may be made of cushioning material as illustrated in FIG. 4. One type of cushioning material that may be employed is foam.

Referring again to FIG. 3, an edge protector 10 is illustrated being held in place next to a corner of a load/object 99 to be lifted. The sling 55 is shown in phantom.

The spacers 18 are designed to provide a larger surface area against which the sling 55 engages the load 99. By virtue of the shape of the spacers 18, this larger surface area is continuous along the length of the spacer (cylindrically-shaped) or length and width of the spacer (cushioning or foam) and a larger surface area is achieved with numerous spacers. By moving the point of contact during a lift from the edge/corner of the load and distributing the force over a larger surface area, damage to the sling 55 is prevented. (Moreover, damage to the load is also prevented.)

In a preferred embodiment, the edge protector 10 does not just provide an additional material insert between the edge/corner and the sling, but is designed to form a tunnel 30 around the sharp edge of the load 99 thereby preventing the edge/corner of the load 99 from engaging and damaging the edge protector and the sling. The distribution of the weight of the load over a larger surface area and the formation of the tunnel are important features of the subject edge protector 10.

In a preferred embodiment, the body section 12 is stitched in half to form two separate "half-pockets." Each half-pocket 27 and 28 holds one or more spacers 18. The stitching 29 helps to separate the spacers 18 and ensures the formation of tunnel 30 when the edge protector 10 engages the load 99. In a preferred embodiment, each half-pocket 27, 28 holds three spacers as illustrated in FIG. 3.

The Velcro® straps 40, 41 of the securing means 14*a*, 14*b*, 24*a*, 24*b* allow the edge protectors 10 to be quickly moved from one sling or lifting chain to another. If the edge protectors need to be moved or repositioned, loosening the Velcro® straps allow the edge protector 10 to slide or releasably attach the edge protectors 10 to a new position on the sling. In other words, the edge protector 10 does not need to be tight (only snug) against the sling 55.

It should be noted that when using metal slings (or towing chains), the sling may damage the object that is being lifted. The subject edge protector will also protect the load from being damaged by dispersing the force over a larger surface area.

It will be apparent to one skilled in the art after reading this disclosure that the means for securing the edge protector 10 to the sling or towing chain is not necessary. For example, when the load is in its rest position, one or more edge protectors may be inserted as the sling is being tightened against the load. The weight of the load 99 as the sling 55 begins its lift will keep the edge protectors 10 in place without the need of the Velcro® straps.

Although this invention has been described and illustrated by reference to specific embodiments, it will be apparent to those skilled in the art that various changes and modifications may be made which clearly fall within the scope of this invention. The present invention is intended to be protected broadly within the spirit and scope of the appended claims.

What is claimed is:

1. An edge protector for use with an industrial sling that lifts or pulls heavy loads comprising:

at least one flexible body portion;

means for securing said body portion to a sling; and means for spacing the sling away from an edge of the load, said spacing means capable of forming a tunnel between said body portion and said edge and distributing a weight of said load over a continuous surface area of said body portion, wherein said means for spacing comprises a plurality of discrete cylindrically-shaped spacers.

2. The edge protector of claim 1 wherein said cylindrically-shaped spacers are comprised of at least one of steel and aluminum.

3. The edge protector of claim 1 wherein said cylindrically-shaped spacers are comprised of nylon.

4. The edge protector of claim 1 wherein said means for securing comprises a plurality of straps having mating Velcro® edges for releasably attaching said edge protector to said sling.

5. The edge protector of claim 1 wherein said body portion comprises a folded, elongated rectangular piece of material, having ends joined to form a ring shaped band with sealed edges.

6. The edge protector of claim 1 wherein said body portion comprises one piece of rectangularly-shaped material placed over a second piece of rectangularly-shaped material and sealed edges.

7. The edge protector of claim 1 wherein said body portion is comprised of nylon.

8. The edge protector of claim 1 wherein said spacers further comprise at least one of cushioning material and foam.

9. The edge protector of claim 1 wherein said body portion comprises a rectangularly-shaped pocket filled with a plurality of cylindrically-shaped spacers, said spacers having a length perpendicular to a length of the rectangularly shaped pocket.

10. The edge protector of claim 9 wherein said at least one pair of mating straps comprise two pairs of mating straps.

11. The edge protector of claim 1 wherein said securing means comprises at least one pair of mating straps, each pair having a first strap attached to one edge of said body portion and a second strap attached to an edge opposite the edge attached to said first strap, said mating straps having a fastening means.

12. The edge protector of claim 11 wherein said fastening means comprises:

said first strap having hook-type fasteners attached to its surface; and said second strap having loop-type fasteners attached to its surface.

13. An edge protector for use with a sling capable of lifting or pulling a heavy load comprising:

a body portion having a first pair of sides, a second pair of sides, a top, a bottom, and at least one pocket formed therein;

a plurality of discrete cylindrically-shaped spacers within the at least one pocket, each spacer providing a continuous surface area for said body portion to contact and distribute a weight of said heavy load; first mating straps on one side of the first pair of sides, and second mating straps opposite the first mating straps, said first mating straps being capable of mating with said second mating straps around at least one of the top and the bottom of the body portion, said body portion capable of being placed around an edge of the heavy load such that a tunnel is formed around said edge to protect said edge from engaging both said body portion and said sling, said tunnel being formed between at least two spacers.

14. The edge protector of claim 13 wherein said first pair of sides comprise a greater length than said second pair of sides.

15. The edge protector of claim 13 wherein said at least one pocket comprises two pockets, each having at least one spacers therein.

16. The edge protector of claim 13 wherein said spacers comprise cylindrically-shaped rods.

17. The edge protector of claim 13 wherein said first and second mating straps comprise Velcro® for releasably attaching said edge protector to said sling.

18. The edge protector of claim 13 wherein said spacers comprise nylon.

19. The edge protector of claim 13 wherein said spacers comprise cylindrically-shaped rods placed in said at least one pocket perpendicular to said first and second pair of sides.

* * * * *